United States Patent [19]

Pernick

[11] 4,010,627

[45] Mar. 8, 1977

[54] KNIT GARMENT, KNIT BLANK THEREFOR AND METHOD OF MAKING SAME

[76] Inventor: David Pernick, 1020 Shore Blvd., Brooklyn, N.Y. 11235

[22] Filed: Jan. 19, 1976

[21] Appl. No.: 650,443

[52] U.S. Cl. ..... 66/177

[51] Int. Cl.[2] ..... A41B 9/02; A41B 9/04; A41B 9/10

[58] Field of Search ..... 66/175, 176, 177, 170, 66/171

[56] References Cited

UNITED STATES PATENTS

| | | | |
|---|---|---|---|
| 2,519,534 | 8/1950 | Artzt | 66/177 |
| 2,651,048 | 9/1953 | Milberg | 66/177 UX |
| 2,837,904 | 6/1958 | Scriggins | 66/176 |
| 3,075,375 | 1/1963 | Garrov et al. | 66/177 |
| 3,479,844 | 11/1969 | Silvain | 66/176 |
| 3,946,579 | 3/1976 | Heinig | 66/177 |

FOREIGN PATENTS OR APPLICATIONS

| | | | |
|---|---|---|---|
| 669,851 | 4/1952 | United Kingdom | 66/178 |
| 1,243,506 | 8/1971 | United Kingdom | 66/177 |

*Primary Examiner*—Ronald Feldbaum
*Attorney, Agent, or Firm*—Nathan Levin

[57] ABSTRACT

A knitted undergarment as formed from a knitted blank made entirely by rotary knitting upon a circle of needles of a circular knitting machine by first knitting a seamless tubular elastic waist encircling turned welt upon all of the needles, then knitting a seamless tubular body section in continuation of the welt upon all of the needles, and then knitting spaced seamless nontubular front and rear narrowed panels in continuation of correspondingly spaced portions of the body section upon correspondingly spaced groups of the needles, the yarn being introduced to the needles for the knitting of each course of the panels and being cut and clamped after the knitting of each such course, so that each course of the narrowed panels is knit of a separate length of yarn. The knitted undergarment is completed by joining the terminal end portions of the panels. The narrowed edges of the spaced panels then delineate spaced leg openings therebetween.

9 Claims, 10 Drawing Figures

KNIT GARMENT, KNIT BLANK THEREFOR AND METHOD OF MAKING SAME

Figure 1:
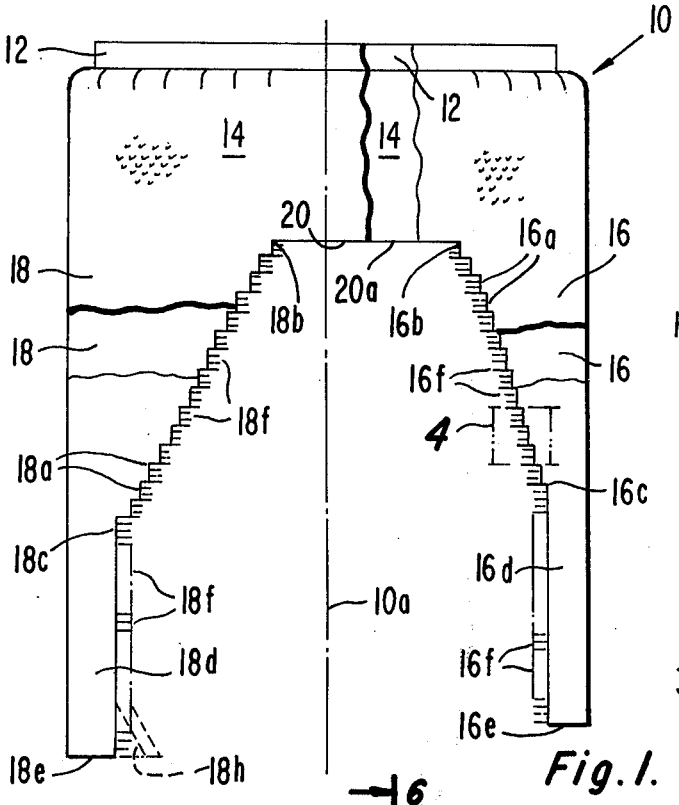

The present invention relates generally to the manufacture of clothing and more specifically to the manufacture of a knitted garment, a knitted blank therefor and to the method of making the same. The garments of the present invention are in the category of undergarments and are made from one-piece knitted blanks of novel shape which are formed to such shape in a novel manner upon a circular knitting machine.

Heretofore, undergarments, particularly those referred to as briefs, intended for use by individuals of at least one of the sexes and of a variety of ages, have generally been made of a plurality of component parts, such as, an elastic waist encircling band, a body section, front and rear panel sections and crotch sections, which have been cut to desired shape and have then been sewn together. Such manufacture of undergarments is expensive in that it is wasteful of time, of labor and of material, and, in addition, often results in undesirable locations of the seams thereof.

It is therefore the primary object of the present invention to provide a knitted garment as made from a unitary knitted garment blank having a seamless knitted tubular elastic waist encircling band, a seamless knitted tubular body section formed in continuation of the band, and seamless knitted non-tubular front and rear panel sections formed in continuation of the body section, such component parts of the knitted blank being integrally formed in a novel manner by rotary knitting upon a circular knitting machine and the garment itself being formed by joining the terminal ends of the panel sections of the garment blank.

With the above and other objects in view which will become apparent from the following detailed description of preferred forms of the invention shown in the accompanying drawings, the present invention resides in the garment, the garment blank therefor and the method of making the same as illustrated and described and as pointed out in the claims.

Figure 3:
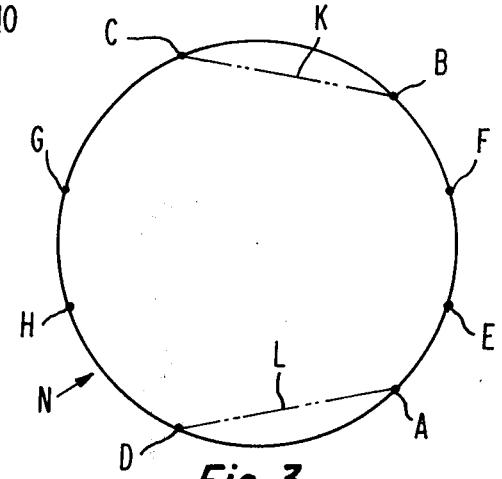
Figure 7:
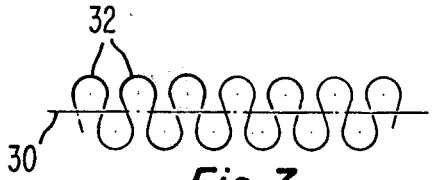
Figure 2:
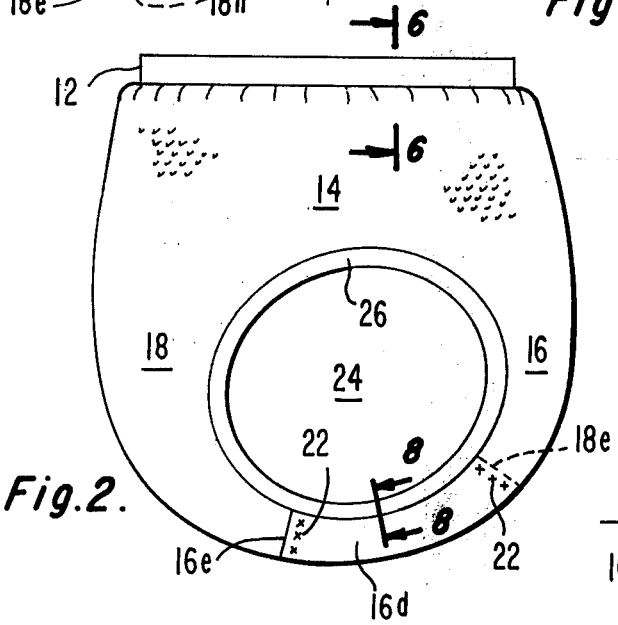
Figure 8:
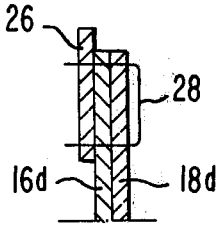
Figure 6:
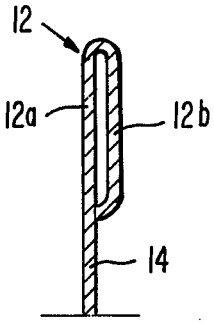
Figure 5:
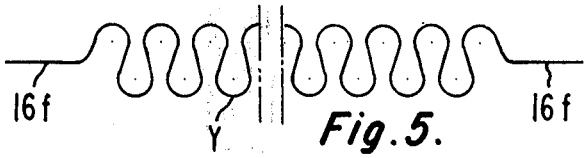
Figure 4:
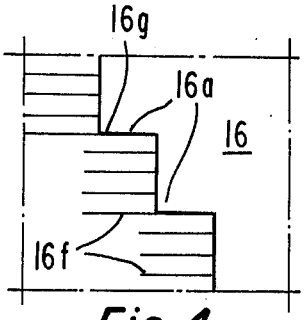
Figure 9:
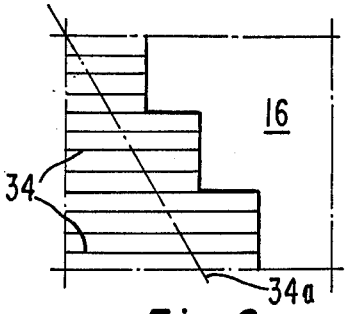
Figure 10:
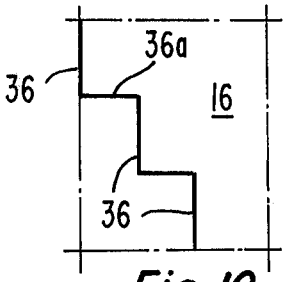

In the drawings:

FIG. 1 is a side elevational view of the knitted garment blank of the present invention, FIG. 2 is a side elevational view of the knitted garment of the present invention as made from the garment blank of FIG. 1, FIG. 3 is a schematic view of a circle of needles of a circular knitting machine upon which the garment blank of FIG. 1 is made, FIG. 4 is an enlarged schematic view of a section of the fabric of the garment blank of FIG. 1 within the rectangle 4 of FIG. 1, FIG. 5 is a schematic view of a knitted course of loops of the fabric of the garment blank as made from an individual length of yarn and showing the yarn extending in non-knitted form from both ends of the course of knitting, FIG. 6 is an enlarged schematic view in section of the elastic waist band of the garment of FIG. 2, as taken along lines 6—6 thereof, FIG. 7 is a schematic view of an elastic yarn incorporated in a course of knitted stitches, FIG. 8 is an enlarged view in section of the crotch portion of the garment of FIG. 2, as taken along lines 8—8 thereof, FIG. 9 is a view similar to FIG. 4, showing a modification in the fabric of the present invention, and FIG. 10 is also a view similar to FIG. 4, showing another modification of the fabric of the present invention.

As shown in the drawings, the knitted garment blank of the present invention comprises a seamless knitted tubular elastic waist encircling band 12 of suitable length and diameter, a seamless knitted tubular body section 14 also of suitable length and diameter, knit in continuation of the waist band, and a pair of oppositely spaced front and rear seamless knitted non-tubular body panels 16 and 18, respectively, of suitable length and circumferential extent, knit in continuation of correspondingly opposite spaced front and rear portions of the body section. The remaining portions of the body section terminate at 20, **20*a* in the final course thereof. The courses of the body section are circular while the courses of the panels are non-circular as in FIG. 5 where a course of stitches of panel 16** is shown made of a length of the yarn Y of which the garment blank is knitted.

The circumferential extent of panel 16 decreases by steps **16*a* from its widest part at 16*b* to its narrowest part at 16*c* and then continues without change in width, as at 16*d*, to its end at 16*e*. Similarly, the circumferential extent of panel 18 decreases gradually by steps 18*a* from its widest part at 18*b* to its narrowest part at 18*c* and then continues without change in width, as at 18*d*, to its end at 18*e*. It will be noted that while rear panel 18 is wider than panel 16 at their upper ends, 18*b* and 16*b*, the rate of narrowing of each panel is different so that they are of substantially the same width at 18*c* and 16*c*, and that their tail ends 18*d* and 16*d* are also of substantially the same width. The panels 16 and 18 may be of uneven length and the narrowing of one of the panels, such as 16, may terminate sooner than the narrowing of the other panel. While the panels may each be considered to be generally triangular in shape, with panel 16 having a pair of edges extending walewise between 16*b*, 16*c* and panel 18 having a pair of edges extending walewise between 18*b*, 18*c*, it will be noted that panel 18 is of greater circumferential extent than panel 16 as can be seen by reference to center line 10*a* of the garment blank 10. The edges of panels 16, 18 are not selvedged and each have short fringe-like lengths or floats of yarn at 16*f*, 18*f*, respectively, extending therefrom, such floats being the result of one method of knitting the blank 10, as will be explained. The floats 16*f* and narrowing steps 16*a* of panel 16 are shown schematically in FIG. 4**.

The garment blank of FIG. 1 is made into the garment of FIG. 2 by suitably overlapping the terminal portions **16*d*, 18*d* of panels 16, 18 in lengthwise direction and then sewing them together, as at 22, 22. In doing so, a pair of oppositely disposed leg openings 24 will be provided, such openings being defined by the corresponding edges 20, 20*a* of the terminal course of body section 14 and by the narrowed edges of panels 16, 18. A suitable elastic trimming, such as shown at 26, may then be sewn in place around each of the two leg openings by stitches 28 which will also serve to enclose floats 16*f*, 18*f* therein. The stitches 28 will also reduce the tendency of the edges of panels 16, 18 and of body section 14 to ravel. It will be understood that the size, shape and location of the panels 16, 18, relative to center line 10*a*, may be varied as desired to accordingly vary the outline of the garment and the size, shape and disposition of the leg openings therein. The portions 16***d*, 18*d*, of the panels, which may be termed the crotch pieces, need not be of uniform width and may be widened out at the ends thereof. One or both of such crotch pieces may be made of terry fabric construction with the terry loops facing the interior of the garment. One or more additional crotch pieces of suitable fabric may be placed alongside or between the crotch pieces 16*d*, 18*d* and secured in such position by the sewing stitches 22, 22 and 28.

The garment blank 10 is preferably made of the yarn Y entirely by rotary knitting upon a circular knitting machine of the type used for the knitting of ladies' hosiery and provided, among other things, with a circle of needles of suitable diameter, a circle of loop transfer instruments, yarn clamp and cutter means and needle selecting means. While a single feed machine may be used, it is preferred that a multiple feed machine be employed to reduce the time required to knit the blanks. The band 12, of jersey fabric, is a turned welt of double wall construction, 12*a*, 12*b*, FIG. 6, and is made in the usual manner upon the circle of needles N, FIG. 3, with the cooperation of the loop transfer instruments. During the formation of the fabric of the welt, one or more strands of elastic yarn 30, FIG. 7, are incorporated therein by knitting the elastic yarn or by inlaying the same in front and in back of one or more spaced stitches 32, FIG. 7, thereby to provide elasticity to the waist band of the garment.

Rotary knitting continues upon the circle of needles N for a sufficient number of courses to provide a suitable length of seamless tubular jersey fabric for the body section 14 of the garment, such body section being made in continuation of and integral with welt 12. Then the needles are selected so that rotary knitting continues upon the groups of needles extending along the arcs AB and CD, FIG. 3, at the start of panels 16, 18, and so that knitting is discontinued upon the groups of needles extending along the arcs BC and AD. The stitches on the idled needles of the groups BC and AD are now cast off since there is no further knitting upon them thereby providing the portions 20, 20*a* of the terminal course of body section 14. As rotary knitting of panels 16, 18 continues upon the groups of needles AB and CD, a predetermined number of the needles at both ends of such needle groups are periodically inactivated after predetermined numbers of courses have been made until knitting is limited to the groups of needles between EF and GH whereby the panels 16, 18 are narrowed along steps 16*a* to 16*c* and 18*a* to 18*c*. The last stitches knit upon one such number of inactivated needles is indicated schematically at 16*g*, FIG. 4.

Thus the number of needles used in the groups thereof knitting the panels are gradually reduced, according to a predetermined plan, from the maximum used for making the fabric at 16*b*, 18*b* to the minimum used for making the fabric at 16*c*, 18*c*. The number of needles being used and the rate at which they are inactivated will determine the shapes of the panels. The stitches on the idled needles are cast off as they are inactivated. Rotary knitting then continues upon the groups of needles EF and GH to form the tail or crotch pieces 16*d*, 18*d* of the garment blank, after which the stitches are cast off from such needles and the blank is complete with the machine ready to make the next blank.

The yarn Y is periodically clamped and cut after the knitting of each of the courses thereof upon the active needles in each of the groups of needles knitting the panels, and the cut ends of the yarn Y are periodically introduced to the same needles for the knitting of such courses. Thus each course of stitches of the panels 16, 18 is made of an individual length of yarn, FIG. 5, with the cut ends thereof extending as short foats 16*f*, 18*f* in nonknitted form from the end stitches thereof. In the machine, the action of the clamp and cutter means is such that the length of the floats 16*f*, 18*f* can be adjusted as desired and can remain at desired length regardless of the number of active needles knitting the yarn. The presence of such floats at the ends of the courses will act to maintain the integrity of the end stitches thereof.

It is within the scope of the present invention to omit the cutting and clamping of the yarn, and to permit the yarn to extend across the needle circle, in each course of knitting, between the last and the first needles of the groups of needles knitting the same, as at K, L in FIG. 3. The length of such floats will increase as panels 16, 18 are made and will be a maximum when extending between F, G and E, H in FIG. 3. Such floats are indicated schematically at 34 in FIG. 9 which shows a portion of the edge of the fabric of panel 16. The floats 34 are then removed by being cut along the line 34*a*, generally parallel to the stepped fabric edge of panel 16, to provide a blank which may then be fashioned into the garment of FIG. 2.

It is also within the scope of the present invention to make the garment blank by a combination of rotary and reciprocating knitting. In such an arrangement, the blank is made as described by rotary knitting up to the beginning of the formation of the panels 16, 18, at which point the knitting machine is caused to reciprocate and the panels are made by reciprocating knitting. The narrowing of the panels is made by periodically inactivating needles at each end of the groups of needles knitting the panels. The stitches of the inactivated needles are cast off along the line 36*a*, FIG. 10.

While the garment blank has been described as being knit by starting with the waist band 12 and then continuing to knit the body section 14 and panels 16, 18, it is also within the scope of the invention to reverse the order of knitting by starting with the end portions 16*e*, 18*e* of the panels and then knitting the panels, the body section 14 and then the waist band 12, the knitting machine beig capable of forming a turned welt at the end of the body section 14. When knitting in such reverse order, the panels are widened by activating needles periodically at each end of the groups of needles, and, at the start of the section 14, the remaining ones of the needles are activated so that all the needles are knitting.

While the present invention has been shown as applied to undergarments, it will be understood that it is applicable to other garments as well wherein there are panel-like sections with walewise extending tapered edges the outlines of which also extend at an angle to the wales of the garment.

It has been pointed out that the crotch portions 16*d*, 18*d* may be of uneven length and that the ends of such portions may be widened out, for example, as shown in dotted lines at 18*h* in FIG. 1. A yarn change may be made at any desired course of the blank, for example, in crotch portion 18*d* adjacent 18*c* so that this crotch portion may be made of cotton yarn when the remainder of the blank is made of other yarn. The crotch portions are so overlapped that portion 18*d* will be on the inner side of the garment, FIGS. 2, 8.

It is within the scope of the invention to terminate knitting after the narrowing of the panels 16, 18, following the points 16*c*, 18*c*, and completing the garment by using separately made crotch pieces to extend between and to be joined to such shortened terminal portions of the panels 16, 18.

It will also be understood that some of the fabric adjacent the narrowed edges of panels 16, 18 may be cut away to provide the desired shape for the leg openings 24, such cutting, if any, usually being done at the same time that the elastic trimming 26 is sewn in place. An overedge type of elastic trimming may be used in place of the flat trimming 26, if desired.

I claim:

1. A knitted garment blank having a seamless knitted tubular body portion of predetermined length, said body portion having wales and courses formed of suitable yarn and having a terminal course, and spaced seamless knitted non-tubular first and second panels of predetermined length interknitted with and extending from correspondingly spaced portions of said terminal course and also having wales and courses formed of suitable yarn, said panels having non-joined separate terminal portions, the wales of said panels being common to wales of said body portion and the courses of said panels being formed of individual lengths of yarn, said panels having non-selvage edges at the ends of the courses thereof, said edges having fringe-like non-knitted floats of yarn extending therefrom, such floats being formed of end portions of said lengths of yarn extending from the terminal stitches of the courses knit therefrom.

2. A garment blank as in claim 1 wherein said non-selvage edges extend at an angle to the wales of said panels.

3. A garment blank as in claim 1 wherein said blank is provided with a seamless knitted tubular welt formed integrally with said body portion at the beginning thereof.

4. A garment blank as in claim 3 wherein elastic yarn is incorporated in said welt.

5. A knitted garment as formed from a knitted garment blank, said blank having a seamless knitted tubular body portion of predetermined length, said body portion having wales and courses formed of suitable yarn and having a terminal course, and spaced seamless knitted non-tubular first and second panels of predetermined length interknitted with and extending from correspondingly spaced portions of said terminal course and also having wales and courses formed of suitable yarn, said panels having non-joined separate terminal portions, the wales of said panels being common to wales of said body portion and the courses of said panels being formed of individual lengths of yarn, said panels having non-selvage edges at the ends of the courses thereof, said edges having fringelike non-knitted floats of yarn extending therefrom, such floats being formed of end portions of said lengths of yarn extending from the terminal stitches of the courses knit therefrom, said terminal portions of said panels in said blank being joined thereby to provide a pair of spaced openings in said knitted garment.

6. A knitted garment as in claim 5 wherein said edges of said panels and the non-spaced portions of said terminal course delineate said spaced openings in said garment.

7. A knitted garment as in claim 6 wherein a trimming is secured to said garment to extend around said spaced openings therein.

8. A knitted garment as in claim 5 wherein said blank is provided with a seamless knitted tubular welt formed integrally with said body portion at the beginning thereof.

9. A knitted garment as in claim 8 wherein elastic yarn is incorporated in said welt.

* * * * *